US011696634B2

(12) United States Patent
Schori

(10) Patent No.: US 11,696,634 B2
(45) Date of Patent: Jul. 11, 2023

(54) CARRIER, MAGNETICALLY ATTACHABLE TO GARMENT

(71) Applicant: Lihie Schori, Netanya (IL)

(72) Inventor: Lihie Schori, Netanya (IL)

( * ) Notice: Subject to any disclaimer, the term of this patent is extended or adjusted under 35 U.S.C. 154(b) by 0 days.

(21) Appl. No.: 17/267,123

(22) PCT Filed: Aug. 8, 2019

(86) PCT No.: PCT/IB2019/056771
§ 371 (c)(1),
(2) Date: Feb. 9, 2021

(87) PCT Pub. No.: WO2020/049382
PCT Pub. Date: Mar. 12, 2020

(65) Prior Publication Data

US 2021/0307495 A1 Oct. 7, 2021

Related U.S. Application Data

(60) Provisional application No. 62/716,564, filed on Aug. 9, 2018.

(51) Int. Cl.
*A45F 5/02* (2006.01)
*A41D 27/20* (2006.01)
(Continued)

(52) U.S. Cl.
CPC ..... *A45F 5/02* (2013.01); *A41D 27/20* (2013.01); *A41F 1/002* (2013.01); *H01F 7/0263* (2013.01);
(Continued)

(58) Field of Classification Search
CPC ..... A45F 5/02; A45F 2200/0516; A45F 2200/0541; A45F 2200/0558;
(Continued)

(56) References Cited

U.S. PATENT DOCUMENTS 3,007,568 A * 11/1961 Kurland ..... A45C 11/325 206/37.1
6,779,199 B1 * 8/2004 O'Dea ..... A41D 19/01594 224/183
(Continued)

FOREIGN PATENT DOCUMENTS

CN 1633931 A 7/2005
WO 2017117681 A1 7/2017

*Primary Examiner* — Adam J Waggenspack
(74) *Attorney, Agent, or Firm* — Mark M. Friedman

(57) ABSTRACT

There is provided a carrier, for carrying one or more personal articles on any part of a garment, comprising a patch, configured to be temporarily attachable to the inner side of the garment and including one or more magnets, configured to hold attached to the outer side of the garment at least one article or articles holder that may be attracted magnetically. There are also provided holders, each formed to hold one or more of the articles and configured to be temporarily attachable to the outer side of the garment and to be magnetically attracted to any of the magnets. Any of the holders may include one or more magnets, configured to be attracted to corresponding magnets in the patch. Any of the holders may be formed as a pouch or a pocket.

9 Claims, 7 Drawing Sheets

(51) Int. Cl.
*A41F 1/00* (2006.01)
*H01F 7/02* (2006.01)

(52) U.S. Cl.
CPC ..... *A45F 2200/0516* (2013.01); *A45F 2200/0541* (2013.01); *A45F 2200/0558* (2013.01)

(58) Field of Classification Search
CPC ..... A45C 13/1069; A45C 2011/002; A41D 27/20; A41F 1/002; H01F 7/0263; A44D 2203/00; Y10S 206/818; Y10T 24/32
USPC ..... 224/182, 183
See application file for complete search history.

(56) References Cited

U.S. PATENT DOCUMENTS 7,854,021 B2 * 12/2010 Compton ..... A41D 27/08 2/243.1
8,317,067 B2 * 11/2012 Lewis ..... A45F 5/02 224/183
9,392,828 B2 * 7/2016 Esagoff ..... A41D 27/20
10,063,271 B1 8/2018 Goldshtein
10,111,471 B2 * 10/2018 Madine ..... A41D 1/04
10,309,433 B2 * 6/2019 Salvatore ..... A45C 13/08
10,455,905 B1 * 10/2019 Baker ..... A41D 27/08
10,634,931 B1 * 4/2020 Zargari ..... G02C 5/143
2005/0167485 A1 8/2005 Taras
2007/0101643 A1 * 5/2007 Yowney ..... A45F 5/08 47/41.15
2008/0023508 A1 * 1/2008 Harchol ..... A45F 5/02 224/183
2008/0110951 A1 * 5/2008 Lauri ..... A45F 5/02 224/183
2009/0014105 A1 * 1/2009 Shattuck ..... A45F 5/02 224/183
2009/0019671 A1 * 1/2009 Trullas ..... A45F 5/02 24/3.3
2009/0288244 A1 * 11/2009 Fullerton ..... A41D 13/0002 2/243.1
2011/0079619 A1 4/2011 Lewis
2011/0280499 A1 * 11/2011 Brundage ..... A45F 5/02 224/183
2013/0200117 A1 * 8/2013 Monro ..... A45F 5/02 224/183
2013/0227764 A1 9/2013 Didavide
2014/0182088 A1 7/2014 Roberts
2014/0312083 A1 10/2014 Scott
2015/0216276 A1 8/2015 Stratton

* cited by examiner

CARRIER, MAGNETICALLY ATTACHABLE TO GARMENT

The present application draws priority from U.S. Provisional Patent Application No. 62/716,564, submitted on 9 Aug. 2018 and titled "Magnetically Attachable Pouch".

THE TECHNICAL FIELD

The technical field is clothing accessories.

BACKGROUND ART

Persons generally carry with them various articles for frequent use, such as a wallet, a mobile telephone, keys, reading- or sun glasses and cosmetic aids. Such articles are usually carried either in a bag of some form (e.g. purse, handbag or tote-bag) or in a pocket of a garment (e.g. trousers or shirt).

Bags have Two Salient Drawbacks:

(1) They are inconvenient and, in the case of hand-carried bags, restrictive of hand movement.

(2) They are prone to loss—by theft or by being inadvertently left somewhere.

Pockets have other drawbacks, namely:

(3) Not all garments (especially those of women) have pockets.

(4) They have limited capacity.

(5) Whenever changing garments, the articles need to be transferred—which is inconvenient and time-consuming.

U.S. Pat. No. 9,392,828 discloses a wearable pocket, namely a pocket that is temporarily attachable to a garment by magnetic means, in which personal articles may be carried.

It consists basically of two members—

(a) a pocket with an imbedded magnet and (b) a button with a magnet and a front body.

The pocket is attachable to the garment from inside (i.e. close to the person's body), while the button is attachable to the garment from outside.

The disclosed pocket indeed overcomes many of the drawbacks of conventional means for carrying personal articles, enumerated above. It has, however, some important limitations: (1) Since the button is rigid, it must be attached from the outside and the pocket must be worn inside—which makes the access thereto difficult. (2) Using a single magnetic contact point may place too much load on the garment, resulting in creases and distortion of its shape.

U.S. Patent Application 2014/0312083 discloses a pocket attachment that can be attached to the waistband of a clothing item. It includes a flap that folds over the waistband and is secured by mutual attraction between magnets in the flap and in the body of the pocket.

This pocket, as well, overcomes some of the enumerated drawbacks. It is, however, limited to specific types of garments (e.g. trousers) and to a specific part of the garment.

Prior art solutions are, moreover, limited to carrying articles in a pocket, thus excluding the possibility of carrying articles directly attached to a garment or carried by another type of holder.

DISCLOSURE OF THE INVENTION

The goal of the present invention is to provide means for carrying personal articles on a person's garment, using magnetic attraction between members across the fabric, that overcome the drawbacks of conventional means and the limitations of prior art.

Particular desired characteristics of the means, addressed by the invention, include—

- carrying articles on the outer side of the garment;
- carrying articles on any convenient part of the garment;
- distributing the load over that part of the garment, while retaining flexibility of the garment;
- choice for carrying a variety of articles either directly attached to the garment or in a holder, attached to the garment;
- possibility of temporarily removing attached articles or holders while keeping the inner magnetically attractive member attached and in place.

According to the present invention there is generally provided a carrier, for carrying personal articles on the body of a person, that is attachable to any part of any garment worn by the person; the term garment may encompass any wearable item, including, for example, a hat, stockings or an overcoat. Such attaching is by magnetic means and thus is temporary, or reversible, since the carrier can be detached from the garment with relative ease, as well as re-attached to the same or another garment. The carrier of the invention includes a magnetically active member, designed to hold personal articles—either by themselves or within a holder—attached to the garment; it is magnetically active owing to one or more magnets included therein. The magnetically active member has a considerable size and is formed of a flexible material; it generally resembles a patch and is therefore referred to in the sequel as a "patch". The patch has the following advantageous characteristics, which differentiate it from prior art:

(a) It is attachable to the inner side of the garment, thus enabling conveniently attaching the article or the holder of articles to the outer side of the garment. It is noted that the terms "inner side" and "outer side" refer to the corresponding sides of any part of the fabric constituting the garment as worn by the person.

(b) It is freely attachable to any part of the garment—limited only by considerations of accessibility, convenience and aesthetics.

(c) Preferably a plurality of magnets are included, disposed at considerable distance from one another—allowing the distribution of gravitational load over a relatively large area of the garment's fabric, thus minimizing its distortion.

(d) Its flexibility allows it to follow any flexing of the garment's fabric due to motions by the person.

Although the carrier as disclosed herein is directed to carrying articles on a garment worn by a person, it is equally applicable, in all disclosed configurations, to carrying articles on other objects in the proximity of a person. Suitable objects are such that include fabric- or sheet-like parts, as, for example, handbags, soft briefcases, perambulator canopies and the like. Therefore the term "garment" in the context of the present invention should be understood to include such objects. It is noted that the terms "inner side" and "outer side", as pertaining herein to a garment, would have no meaning for such objects and the disclosed carrier would be applicable to either side of a sheet-like part of such objects. In a first configuration of a carrier according to the invention, there is provided a patch, which includes one, or preferably more, magnets, designed to be temporarily attached to the inner side of a garment and to magnetically hold attached to the outer side of the garment an article, or a holder of articles, that may be attracted magnetically. When thus attached, the article, or a holder of articles, is in effect carried by the person wearing the garment. A notable example of an article to be thus carried is an electronic device, such as a mobile telephone; another example is reading- or sun-glasses. A holder of articles may be any suitable device, such as a portable pocket, a small bag, a lug or a strap. It is assumed that such an article, or holder of articles, includes some ferromagnetic material—whether permanently magnetized or not.

In a second configuration of a carrier according to the invention, there are provided— a patch similar to that in the first configuration and— one or more holders of personal articles, wherein each holder includes ferromagnetic material and is designed to be temporarily attached to the outer side of the garment and to be held there by being magnetically attracted to the magnets in the patch. A holder may be formed as a pouch or pocket, so as to hold a variety of articles, or it may be formed to specifically hold a particular class of personal articles. Preferably, the ferromagnetic material of the holder is permanently magnetized and, more preferably, is formed as one or more magnets, disposed in a pattern congruent with that of the magnets in the patch and their polarity being such that they exert mutual attraction with corresponding magnets in the patch when placed in their proximity.

In a third configuration of a carrier according to the invention, there are provided— a patch similar to that in the first configuration and— one or more ferromagnetic members that are semi-permanently attachable to corresponding articles and are designed to be temporarily attached to the outer side of the garment and to be held there by being magnetically attracted to the magnets in the patch, thereby holding the corresponding articles. The ferromagnetic material in these members may be passive or permanently magnetized.

The articles may be any such that need to be carried by the person while being readily reachable for use—for example, an electronic device, such as a mobile telephone, or eye glasses or a pen. The semi-permanent attaching may, for example, be by means of soft glue, such that keeps the ferromagnetic member attached to the article over any desired period of time but also enables detaching it when desired. Preferably more than one article, with its ferromagnetic member, may be simultaneously attachable in this manner to the garment and held there by a single common patch—possibly by corresponding magnets therein.

In an improved version of any of the configurations, the carrier further includes an anchor member (to be referred to also as anchor) for holding the patch in place even while no article, or holder of articles, is magnetically attached thereto. Such an anchor includes ferromagnetic material and is attachable to the outer side of the garment and is attractable by one or more of the magnets in the patch.

Optionally, the magnets in the patch are divided into two groups, being disposed with mutually opposite polarities. The polarity of the first group is such as to attract corresponding magnets in the articles or the holders, while the ferromagnetic material in the anchor is formed as magnets with polarity such as to be attracted by the magnets of the second group.

In a variation of any of the configurations, the patch may itself be formed as a pocket, to hold small, preferably flat, articles, such as documents or bank notes.

More concisely, the invention, in one aspect, is of a carrier, for carrying one or more personal articles on any part of a garment, comprising a patch, configured to be temporarily attachable to the inner side of the garment and including one or more magnets, configured to hold attached to the outer side of the garment at least one article or articles holder that may be attracted magnetically. Any of the articles or articles holders may be such that include a paramagnetic material. Any of the articles holders may be formed as a pouch or a pocket. There is also an option for the patch to be formed as a pocket.

In some configurations, the carrier further comprises an anchor member, attachable to the outer side of the garment and including a ferromagnetic part configured to be magnetically attracted by at least one of the magnets and to thereby secure the patch in place.

In another aspect the invention is of a carrier, for carrying one or more personal articles on any part of a garment, comprising— a patch, configured to be temporarily attachable to the inner side of the garment and including at least one magnet, and one or more holders, each formed to hold one or more of the articles and configured to be temporarily attachable to the outer side of the garment and to be magnetically attracted to any of the magnets. Any of the holders may include one or more magnets, configured to be attracted to corresponding magnets in the patch. Any of the holders may be formed as a pouch or a pocket or may be formed to hold a class of article types.

In some configurations, the carrier in this aspect further comprises an anchor member, attachable to the outer side of the garment and including a ferromagnetic part configured to be magnetically attracted by at least one of the magnets and to thereby secure the patch in place. In certain ones of these configurations— the patch includes at least two magnets, divided into a first and second group, the two groups being disposed in the patch with mutually opposite polarity, the holder includes one or more magnets, configured to be attracted to corresponding magnets of the first group in the patch and the ferromagnetic part in the anchor member is one or more magnets, configured to be attracted to corresponding magnets of the second group in the patch.

In yet another aspect the invention is of a carrier, for carrying one or more personal articles on any part of a garment, comprising— a patch, configured to be temporarily attachable to the inner side of the garment and including at least one magnet and at least one ferromagnetic member, semi-permanently or permanently attachable to one of the articles or to a holder of the articles and configured to be temporarily attachable to the outer side of the garment and to be magnetically attracted to any of the magnets.

It will be appreciated that the invention, as disclosed above, advantageously meets all the goals listed at the beginning of this section.

BRIEF DESCRIPTION OF DRAWINGS

The invention will now be explained in more detail, in terms of specific embodiments by way of examples, with reference to drawings, of which—

BEST MODE FOR CARRYING OUT THE INVENTION

Figure 1:
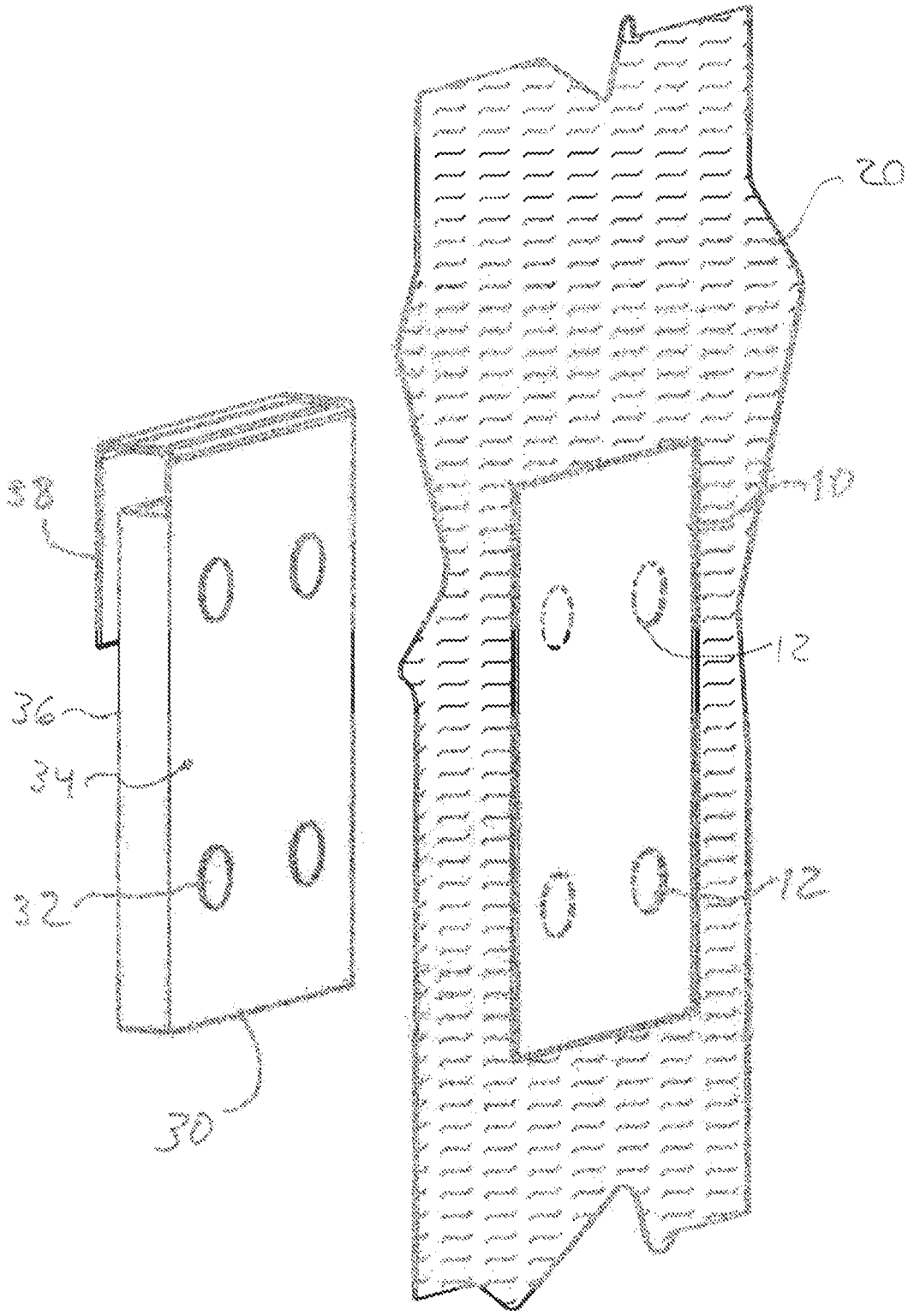
FIG. 1 is a schematic trimetric drawing, in an exploded view, of a carrier according to one configuration of the invention, which includes a pouch as an example of a holder.

Turning to FIG. 1, there is shown a first configuration of a carrier according to the invention, adapted to carry various personal articles on a person's garment. A back patch 10 (to be referred to as "patch" for short, the two terms to appear interchangeably)) is a flexible flat object adapted to be placed on the inner side of any suitable part of the garment 20 and to be held attached thereto by magnetic means as will be explained below. The patch 10 may have any shape (though in the illustration it is shown as a rectangle) and its dimensions are chosen to suit the sizes, weights and number of articles to be carried; the dimensions may also be proscribed by the dimensions of the part of the garment to which it is to be attached. The patch may be made of any suitable flexible material, such as a fabric or a sheet of plastic material. Optionally the patch may be reinforced by flexible ribs (not shown), as is known in the art. Also optionally, the patch may have aesthetic design features, such as colors, patterns and decorations.

Embedded in the patch 10 are one or more magnets 12; if more than one, they may be placed in any suitable pattern, though preferably at maximum practical distances from each other. The term magnet is used throughout this disclosure to represent a piece of ferromagnetic material that is permanently magnetized. The magnets 12 have a relatively short cross dimension, i.e. have a flat shape, and are readily available commercially; for example they may be of the type that are employed for placing small objects on a door of a refrigerator. The magnets are embedded in the patch by any suitable means, such as closed pockets or threads or fasteners or glue.

Also shown in FIG. 1 is an example of a holder 30 for holding various personal articles, such as cards, keys, a small purse or toiletry items. In the illustrated example the holder 30 is a pouch, which includes a back 34, a pocket 36 and a closing flap 38. The pouch may be made of any suitable material as is known in the art. The closing flap 38 may be made to temporarily adhere to the pocket 36 by any suitable means, such as snap buttons or magnets.

Preferably embedded in the back 34 of the pouch 30 is a plurality of magnets 32—in a pattern that is congruent with that of the magnets 12 on the patch 10. The magnets 32 may be similar to the magnets 12 in the patch 10 and the manner of their imbedding may be with any practical means, including those described above with respect to magnets 12. The polarity of the magnets 32 relates to that of the magnets 12 on the patch so that they would be mutually attracted.

In operation, a person would place the pouch 30 on the outer side of the garment 20—at any desired or convenient part thereof—and then place the patch 10 on the inner side of the garment, opposite and reasonably aligned with the pouch, letting corresponding pairs of magnets 12 and 32 attract each other. Alternatively, the patch may be placed from inside first and then the pouch be aligned with it from outside. As a result, both the patch and the pouch will become temporarily attached to the garment by the magnetic force between them and the friction with the garment's fabric. When desired, the pouch may be pulled away from the garment.

In alternative configurations, the magnets 32 may be replaced by pieces of unmagnetized ferromagnetic material, which would be attracted to the magnets 12 on the back patch by magnetic induction. Such configurations may be suitable for carrying a relatively light load of articles, since clearly the magnetic force between the holder and the patch would be weaker than when active magnets are employed. It is noted that both a magnet and a piece of unmagnetized ferromagnetic material may be commonly referred to as ferromagnetic pieces or -material. It is also noted that materials with other magnetic properties, such as paramagnetic or ferrimagnetic materials, may be employed for magnetic attraction; in the present context the term "ferromagnetic" should be understood as applying to all of these materials as well.

Figure 1A:
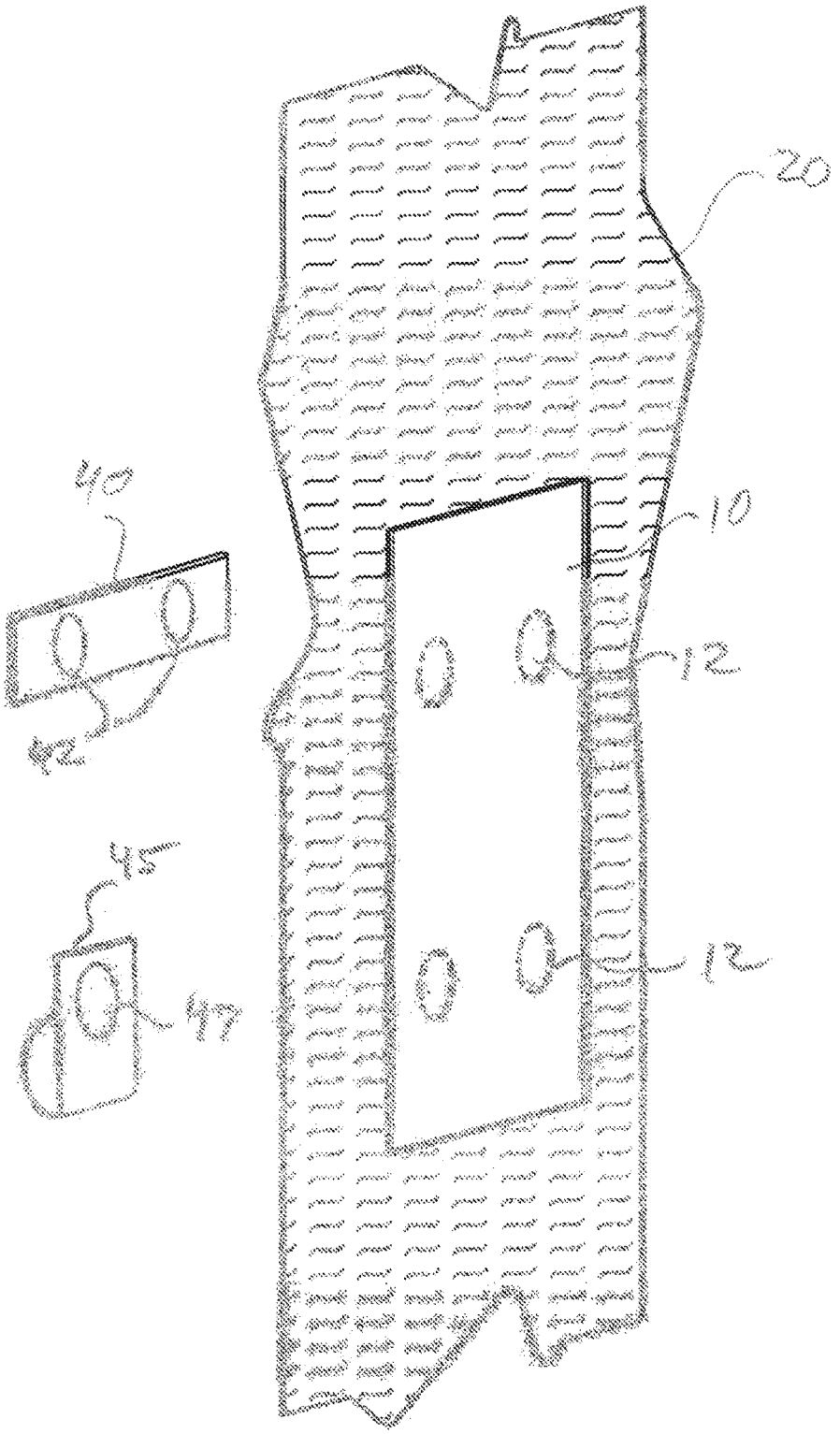
FIGS. 1A and 1B show alternative examples of a holder in the configuration of FIG. 1.
Figure 1B:
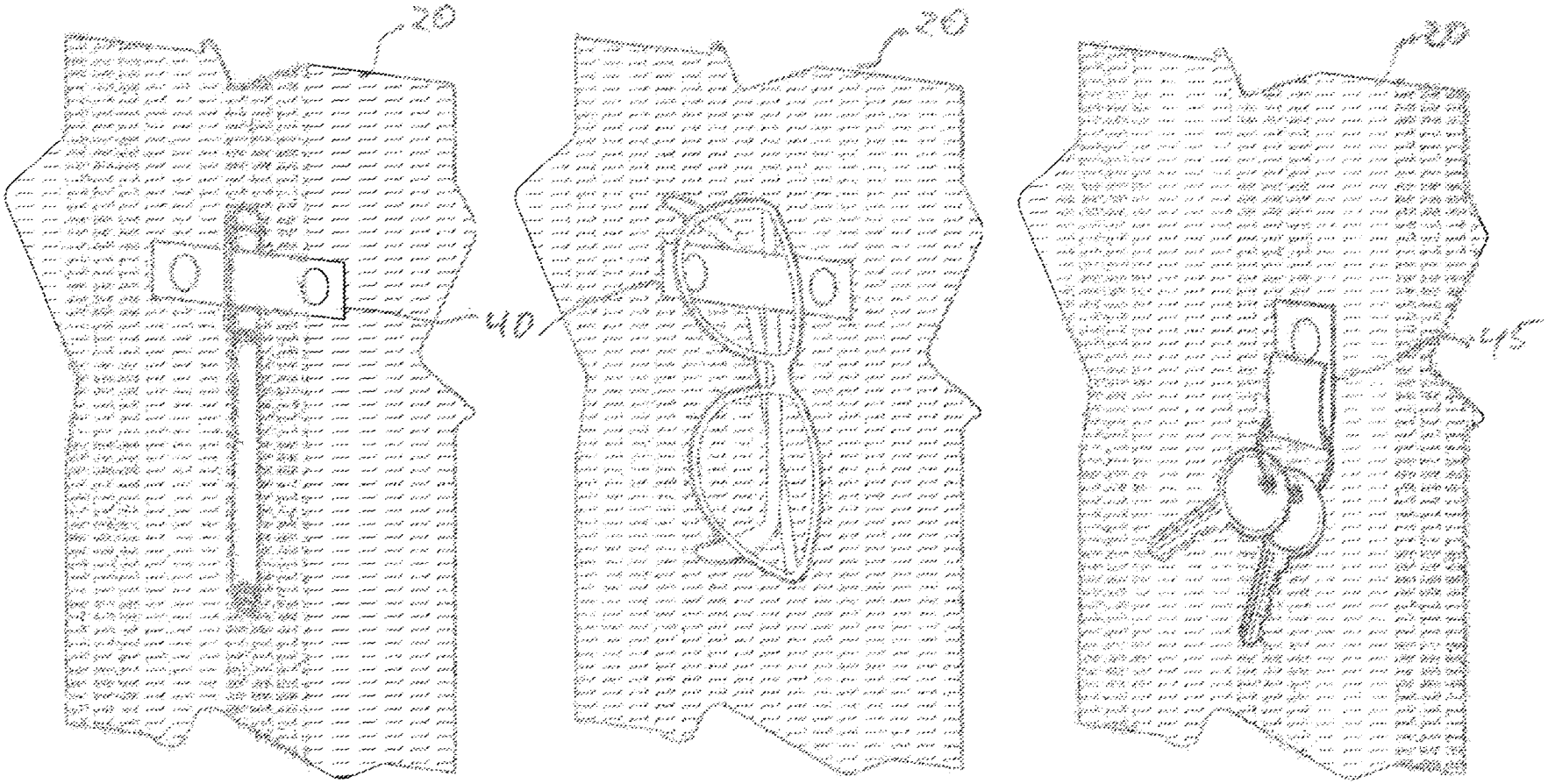

Turning now to FIGS. 1A and 1B, there are shown examples of other holders—alternative to the pouch 30 of FIG. 1—for holding and carrying personal articles. Possibly such a holder may be designed or adapted for a particular class of articles. Thus, for example, the holder shown in the upper part of FIG. 1A may be used to hold any of various elongated articles, such as a pair of spectacles (eye glasses) or a pen. The holder in this case is formed as a short flexible strap 40, with a magnet 42 embedded in each of its two ends. The mutual positions of the magnets 42 will be congruent to those of corresponding magnets 12 on the patch 10. In operation, the strap 40 would be placed on the outer side of the garment as described above with respect to the pouch. A pen, for example, may then be inserted between the strap and the garment, with its clip straddling the strap, as shown in the left-hand drawing in FIG. 1B. A pair of spectacles, as another example, may be held by the strap, by inserting one of the temples between it and the garment or by temporarily detaching one end of the strap and then reattaching it while embracing both temples—leading to the situation illustrated in the middle drawing in FIG. 1B.

Another type of a holder 45, for example, is shown in the lower part of FIG. 1A and may be used to hold pending articles, such as a set of keys. It has generally the shape of a hook and is preferably made of a rigid material; it preferably has a single imbedded magnet 47, but may also have two magnets, arranged one above the other. In operation, the hook 45 would be placed in proximity to a magnet (or magnets) 12 in the patch 10. Then various objects may be hung on the hook, as demonstrated by the set of keys illustrated in the right-hand drawing in FIG. 1B.

It is noted that FIG. 1A also illustrates the possibility of carrying a plurality of holders (which may be dissimilar) with a single back patch. Here, for example, both a strap and a hook are held magnetically attached to the single patch.

In practice, a carrier as described may be supplied as a set of diverse members that includes one or more back patches—possibly of various sizes—and one or more holders—possibly of various types and/or colors and textures. Generally any of the holders may be used in conjunction with any one patch. Possibly a plurality of holders may be used simultaneously in conjunction with one patch; for example, two straps 40 (FIG. 1A) may be used with a patch 10 (FIG. 1)—one strap being coupled to the upper two magnets and one—to the lower two.

Figure 2:
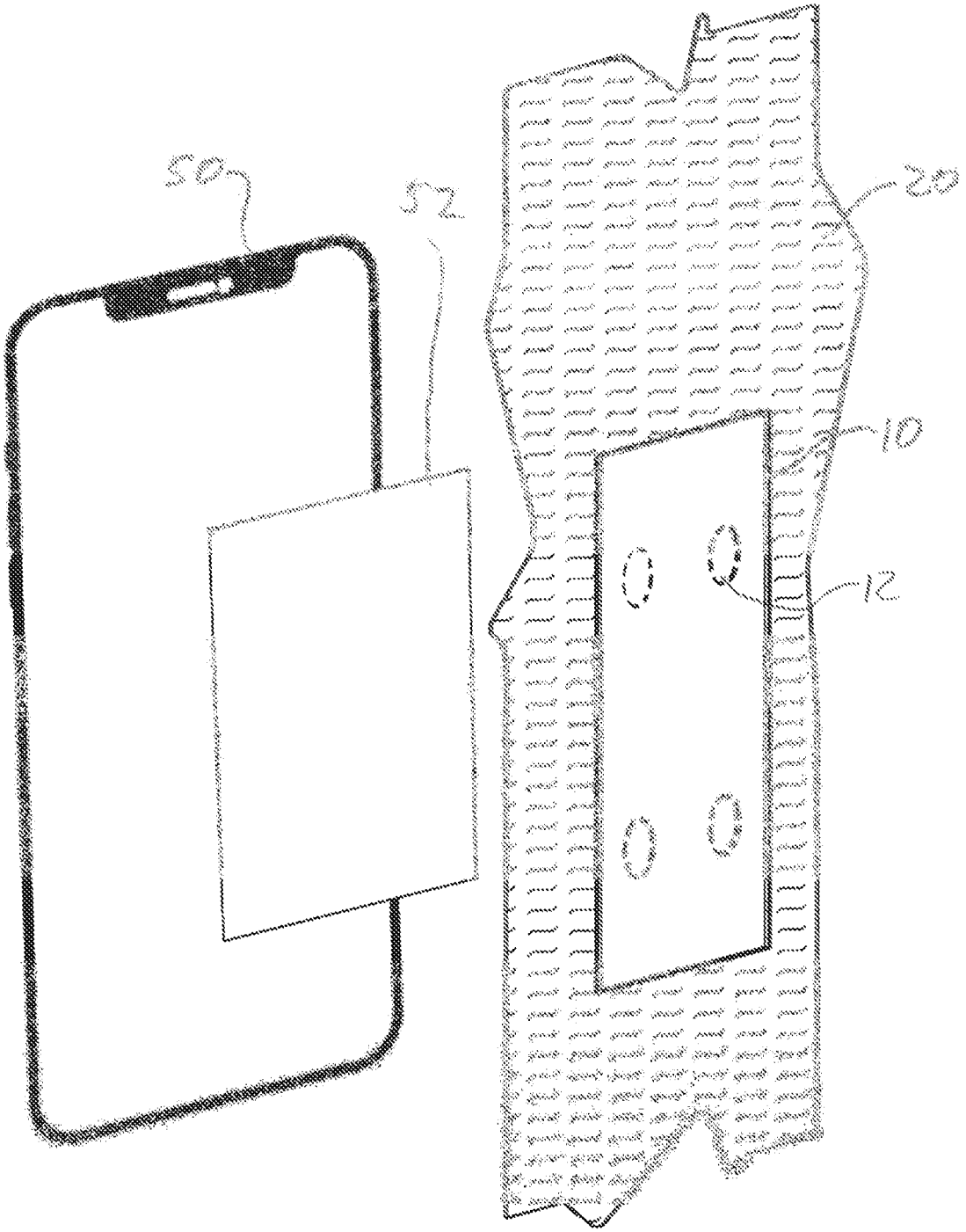
FIG. 2 is a schematic trimetric drawing, in an exploded view, of a carrier according to another configuration of the invention, showing an electronic device as an example of a carried article.

Turning now to FIG. 2, there is shown an example of a configuration from a second group, which differs from the first group of configurations, discussed hereabove, in that these configurations do not include a holder. Instead, these configurations are aimed at carrying articles directly on the garment. In the example illustrated in FIG. 2, the article is an electronic device, such as a mobile telephone.

In common with the configuration of FIG. 1, there is provided a patch 10, with magnets 12, to be placed on the inner side of the garment 20. Instead of a holder, however, there is provided a flat piece, or sheet, of ferromagnetic material 52 (to be termed "ferromagnetic member"), one face of which is coated with a sticky substance. The ferromagnetic member is sized so as to encompass the pattern of magnets 12, or possibly part of that pattern. The ferromagnetic member may also be provided as a plurality of ferromagnetic pieces (as will be shown in greater detail with reference to FIG. 2B). For protection prior to use, the coated face may be covered by a peelable foil (not shown). The ferromagnetic member would be semi-permanently or permanently attached by the user to the article—a mobile telephone 50 in the illustrated example—by placing its coated face in contact with the article. Semi-permanent attachment, namely the ability to remove the ferromagnetic member intact, when desired, is a function of the nature of the sticky substance. The article may then be temporarily attached to the garment in the same manner as the holder in the previously described configurations (e.g. FIG. 1), to be held there by the magnetic attraction exerted by some or all of the magnets 12 on the ferromagnetic member 52.

Figure 2A:
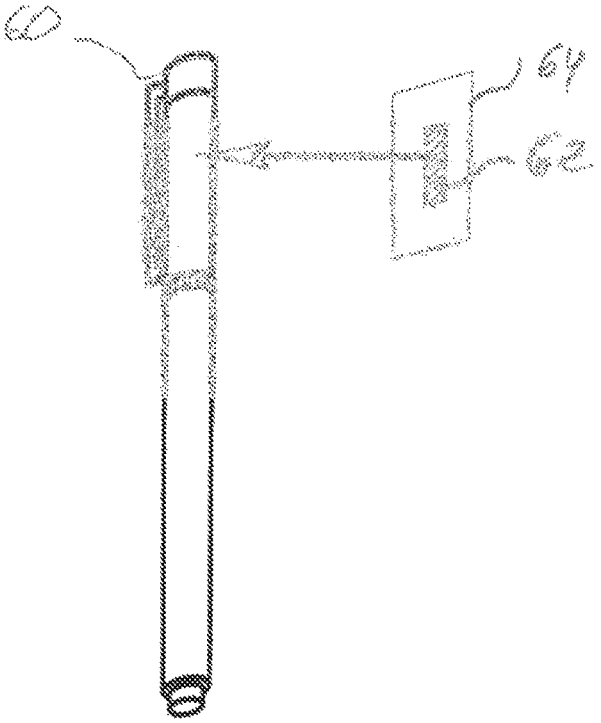
FIGS. 2A and 2B show alternative examples of carried articles in the configuration of FIG. 2.

Another configuration of the second group is illustrated in FIG. 2A. Here a ferromagnetic member 62 is sized and shaped to be applicable to a small article, such as a pen 60. The front face of the ferromagnetic member is, again, coated with a sticky substance and covered by a peelable foil. For convenience, the ferromagnetic member may be supplied lightly attached to a backing foil 64—possibly together with additional similar units (not shown). The user would remove the foils and stick the ferromagnetic member on a pen or a similar object, which may then be magnetically (thus temporarily) attached to a garment with a back patch, as described hereabove.

Figure 2B:
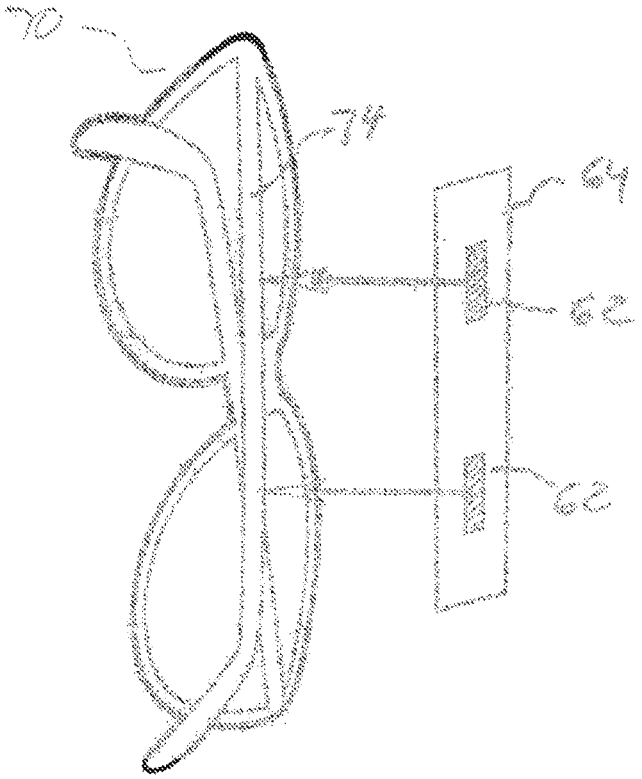

Yet another configuration of the second group is illustrated in FIG. 2B. Here a pair of ferromagnetic members 62—similar to those of FIG. 2A—are attached to a backing foil 64 and mutually positioned so as to be applicable to an elongated object, such as a temple of a pair of spectacles 70. The user would remove the protective foil, then apply the pair of ferromagnetic members to the temple 74 and finally remove the backing foil. The spectacles may then be magnetically (thus temporarily) attached to a garment as described hereabove.

In practice, a carrier with a configuration of the second group may be supplied as a set of one or more back patches and a plurality of ferromagnetic members, such as 52 in FIG. 2 or 62 in FIG. 1A and/or FIG. 1B—the latter arranged as arrays on one or more backing foils. A user would adhere any of the ferromagnetic members to articles that he wishes to carry and would then carry them interchangeably, held by a suitable one of the patches as described above. It is noted that a plurality of articles may be carried with a single patch if it is large enough and includes sufficient magnets.

Alternatively, a carrier according to the invention may be supplied as only a single back patch or a set of possibly assorted back patches. This is intended to be used to carry articles, and possibly holders, that are already adapted to be magnetically attracted—for example if they inherently include ferromagnetic parts or if such parts have been intentionally added to them.

Figure 3A:
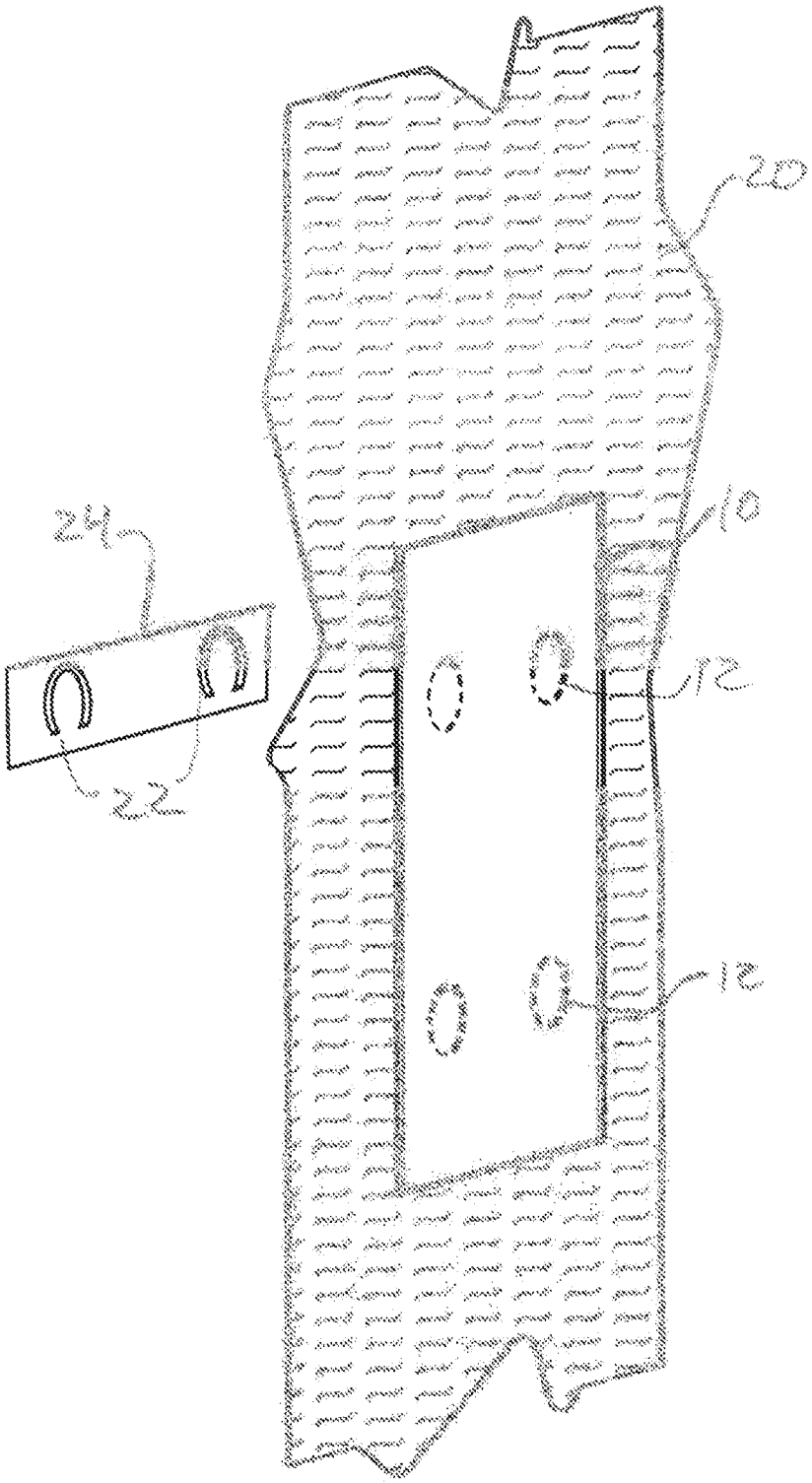
FIG. 3A illustrates schematically, in an exploded view, an improvement applicable to the configurations of FIGS. 1 and 2.

Turning now to FIG. 3A, there is shown a first version of a novel improvement—applicable to any configuration of the carrier of the present invention. There is provided an anchor patch 24 (to be termed "anchor" for short), in which one or more pieces of ferromagnetic material 22 are embedded. The anchor patch may be made of any suitable material—preferably flexible—and may possibly have decorative features; if very small, it may be rigid and include only a single ferromagnetic piece. When the number of ferromagnetic pieces is greater than one, they are arranged in a pattern congruent with that of some of the magnets 12 in the back patch 10; alternatively, there may be a single, elongated ferromagnetic piece, spanning two or more magnets 12. The anchor serves to hold the back patch in place during times that no articles or holders are magnetically attached, such as, for example, when temporarily using a carried article or looking into a carried pouch or when exchanging between different articles carried.

In operation, the anchor would first be placed on the outer side of the garment so as to align its ferromagnetic pieces with one or more of the magnets in the patch placed on the inner side of the garment, thereby causing mutual magnetic attraction to keep the two patches attached to the garment. A holder or an article with non-magnetized ferromagnetic pieces would then be attached, over the anchor, to the garment as described hereabove. The magnetic field of the magnets 12 is generally strong enough to attract all the ferromagnetic pieces—in both the anchor and the carried articles or holders. When such an article or holder is removed, the anchor remains in place, still attracted by the magnets, thus keeping also the back patch in place.

Figure 3B:
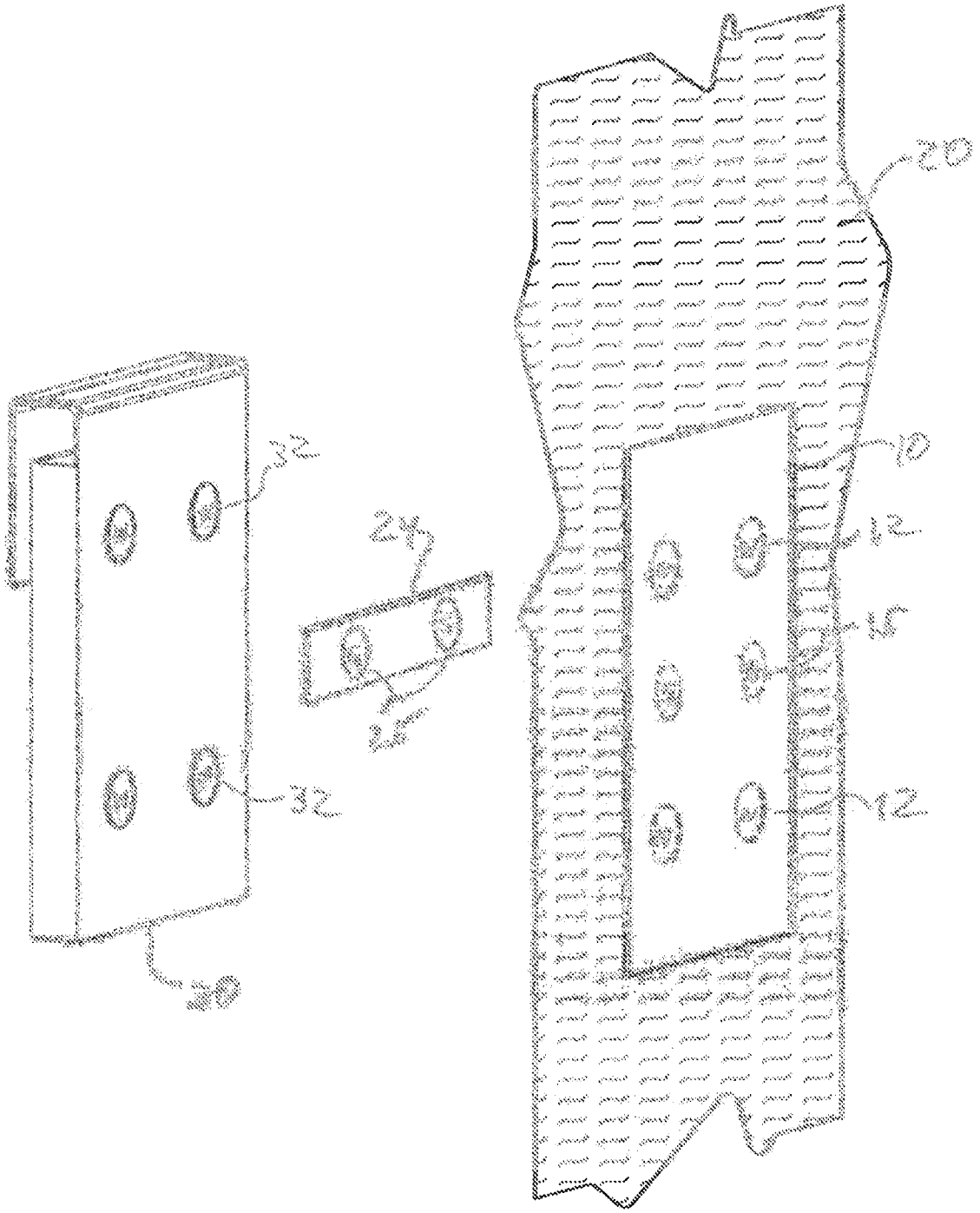
FIG. 3B illustrates an alternative version of the improvement of FIG. 3A.

FIG. 3B shows an alternative version of the improvement of FIG. 3A—particularly suitable for configurations in which a holder includes active magnets (such as in FIG. 1). Such magnets, if placed directly over the ferromagnetic pieces of the anchor, could pull the anchor off the garment when the holder is removed. Therefore, in the version of FIG. 3B, the anchor is provided with magnets 25 (instead of passive ferromagnetic pieces), whose polarity (say South, as marked) is opposite that of the magnets 12 in the back patch (marked as North). The back patch is moreover provided with additional embedded magnets 15, in a pattern congruent with that of the anchor magnets 25 and of similar polarity (i.e. South and therefore opposite that of the other patch magnets 12); alternatively the back patch may be provided with pieces of passive ferromagnetic material—in congruence with anchor magnets 25.

Operation of the version of FIG. 3B is similar to that of FIG. 3A, except that, when positioning the anchor with respect to the back patch, the anchor magnets 25 are magnetically detracted from the regular patch magnets 12 (because of their mutually opposite polarity), but are attracted to the additional magnets 13 or the ferromagnetic pieces in the patch. The regular magnets 12 in the patch thus serve only to attract the articles or holders to be carried (such as the pouch 30 with its magnets 32, having the same polarity, i.e. North) and the removal of the latter will not interfere with the function of the anchor in holding the patch in place.

INDUSTRIAL APPLICABILITY

A carrier according to the invention is readily producible from available parts and materials and using conventional industrial processes.

The invention claimed is:

1. A carrier, for carrying one or more personal articles on a garment, comprising— a patch, configured to be attachable to the inner side of the garment and including at least two magnets, divided into a first and second group, the two groups being disposed in the patch with mutually opposite polarity;

an anchor, attachable to the outer side of the garment proximate the patch and including one or more magnets, each magnet configured to be magnetically attracted, when the anchor is thus attached, to a magnet of the second group in the patch and to thereby secure said patch in place even when no article or article holder is attached to the outer side of the garment; and one or more holders, each formed to hold one or more personal articles and configured to be attachable to the outer side of the garment proximate the patch while also the anchor is attached, each holder including one or more magnets, each magnet configured to be attracted, when the holder is thus attached, to a magnet of the first group in the patch;

wherein the anchor and each of said holders are configured to not be magnetically attracted to each other.

2. The carrier of claim 1, wherein said patch is formed as a pocket.

3. The carrier of claim 1, wherein one or more of said holders is formed as a pouch or a pocket.

4. The carrier of claim 1, wherein one or more of said holders is formed to hold a class of article types.

5. The carrier of claim 1, further comprising— one or more ferromagnetic members, each configured to be joinable to a personal article or to a holder of a personal article so as to render said article or holder to be attachable to the outer side of the garment proximate said patch, when attached, and to be magnetically attracted to at least one of the magnets in the patch.

6. The carrier of claim 5, wherein any of said articles is an electronic device.

7. The carrier of claim 1, wherein each of said holders is disjoint from said patch.

8. The carrier of claim 1, wherein said patch is configured to hold attached to the outer side of the garment a plurality of said article holders simultaneously.

9. The carrier of claim 5, wherein said patch is configured to hold attached to the outer side of the garment a plurality of said articles or holders simultaneously.

* * * * *